US009885361B2

(12) United States Patent
Kwon

(10) Patent No.: US 9,885,361 B2
(45) Date of Patent: Feb. 6, 2018

(54) CENTRIFUGAL FAN FOR DEVICES INCLUDING REFRIGERATORS

(71) Applicant: Dongbu Daewoo Electronics Corporation, Seoul (KR)

(72) Inventor: Hyuk Jang Kwon, Incheon (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 835 days.

(21) Appl. No.: 14/187,900

(22) Filed: Feb. 24, 2014

(65) Prior Publication Data

US 2015/0184663 A1 Jul. 2, 2015

(30) Foreign Application Priority Data

Dec. 30, 2013 (KR) ..... 10-2013-0166419

(51) Int. Cl.

*F04D 17/10* (2006.01)
*F25D 17/06* (2006.01)
*F04D 29/28* (2006.01)
*F04D 29/30* (2006.01)

(52) U.S. Cl.

CPC ..... *F04D 17/10* (2013.01); *F04D 29/281* (2013.01); *F04D 29/30* (2013.01); *F25D 17/062* (2013.01); *F25D 2317/0683* (2013.01); *F25D 2500/02* (2013.01)

(58) Field of Classification Search

CPC ..... F04D 17/10; F04D 29/281; F04D 29/30; F25D 17/062; F25D 2317/0683; F25D 2500/02; F25D 2500/04

See application file for complete search history.

(56) References Cited

U.S. PATENT DOCUMENTS 4,828,456 A * 5/1989 Bodzian ..... F04D 29/444 415/209.1
5,525,036 A * 6/1996 Park ..... F04D 29/4213 415/208.1
7,048,499 B2 * 5/2006 Mathson ..... F04D 17/06 415/119
7,264,446 B2 * 9/2007 Yoshida ..... F04D 17/04 29/889.4
7,281,898 B2 * 10/2007 Baek ..... F04D 29/282 415/206
7,615,897 B2 * 11/2009 Kinoshita ..... H02K 9/06 310/52

(Continued)

FOREIGN PATENT DOCUMENTS

CN 102301144 A 12/2011
CN 203175969 U * 9/2013

(Continued)

*Primary Examiner* — Ryan J Walters

(57) ABSTRACT

A centrifugal fan for a refrigerator can include a plurality of vanes arranged radially about a central a shaft; a ring-shaped shroud coupled to the vanes and having a curved portion with a predetermined radius or curvature and also having an angled portion with a predetermined gradient or angle relative to the curved portion; and a bottom surface coupled to the vanes on the side opposite the shroud; where a ratio (r/R) of an inner diameter r, which is the shortest distance between the vane and the shaft, and an outer diameter R, which is the longest distance between the vane and the shaft, is approximately 0.69±0.01.

16 Claims, 6 Drawing Sheets

(56) References Cited

U.S. PATENT DOCUMENTS

| | | | | |
|---|---|---|---|---|
| 7,815,418 | B2 * | 10/2010 | Suzuki | F04D 29/384 415/222 |
| 7,909,572 | B2 * | 3/2011 | Suzuki | F04D 29/384 415/211.2 |
| 8,881,396 | B2 * | 11/2014 | Hall | F04D 29/023 29/513 |
| 9,206,817 | B2 * | 12/2015 | Mitsuishi | |
| 2003/0012649 | A1 * | 1/2003 | Sakai | F04D 29/30 415/206 |
| 2005/0152781 | A1 * | 7/2005 | Baek | F04D 29/282 415/206 |
| 2005/0220613 | A1 * | 10/2005 | Yoshida | F04D 17/04 415/206 |
| 2006/0034686 | A1 * | 2/2006 | Smiley, III | F04D 29/4226 415/204 |
| 2007/0031250 | A1 * | 2/2007 | Suzuki | F04D 29/384 415/220 |
| 2007/0274833 | A1 * | 11/2007 | Sakai | F04D 29/30 416/204 R |
| 2008/0292464 | A1 | 11/2008 | Keber et al. | |
| 2011/0008170 | A1 * | 1/2011 | Suzuki | F04D 29/384 416/191 |
| 2012/0201680 | A1 * | 8/2012 | Hall | F04D 29/023 416/178 |
| 2015/0037154 | A1 * | 2/2015 | Hall | F04D 29/023 416/178 |
| 2015/0184663 | A1 * | 7/2015 | Kwon | F04D 29/281 415/191 |

FOREIGN PATENT DOCUMENTS

| | | | | | |
|---|---|---|---|---|---|
| EP | 1550811 | A2 | | 7/2005 | |
| EP | 2385258 | A1 | | 11/2011 | |
| EP | 2503157 | A1 | * | 9/2012 | F04D 29/281 |
| GB | 2063365 | A | | 6/1981 | |
| JP | 10153194 | A | * | 6/1998 | |
| JP | 2001193689 | A | * | 7/2001 | |
| KR | 1020020019153 | A | | 3/2002 | |
| KR | 1020030051088 | B | | 6/2003 | |
| SU | 629363 | A | * | 9/1978 | |
| WO | WO 2014080899 | A1 | * | 5/2014 | F04D 29/283 |

* cited by examiner

CENTRIFUGAL FAN FOR DEVICES INCLUDING REFRIGERATORS

CROSS-REFERENCE TO RELATED APPLICATION

This application is based on and claims priority to Korean Patent Application No. 10-2013-0166419, filed on Dec. 30, 2013, with the Korean Intellectual Property Office, the disclosure of which is incorporated herein in its entirety by reference.

TECHNICAL FIELD

Embodiments according to the present disclosure relate to a centrifugal fan that can be used in devices such as refrigerators.

BACKGROUND

In general, a refrigerator provides cool air using a refrigeration cycle, and can cool food and/or prevent it from spoiling. A refrigerator is a device (e.g., an appliance) that can store food and keep it in a fresh state for a relatively long time using cool air. A fan is installed in the refrigerator in communication with a duct that circulates the cool air to and through a cold (refrigeration) compartment and/or a freezer compartment.

FIG. 1 is a cross-sectional view of an example of a refrigerator.

As illustrated in FIG. 1, the refrigerator generally includes an outer case 1 forming an outer frame with an open front surface, and an inner case 2 installed within the outer case 1.

A storage compartment 3 (e.g., the cold compartment or the freezer compartment) is inside the inner case 2. A door or doors 4 are installed at the open front surface of the outer case 1, to allow a user to access the cold compartment and/or the freezer compartment.

Air from the storage compartment 3 is cooled by exchanging heat with a refrigerant in an evaporator 5. The cool air circulates between the outer case 1 and the inner case 2 and also circulates within the inner case 2 (e.g., within the storage compartment 3).

A blower device 10 (e.g., a fan) that circulates the cool air is mounted on the evaporator 5.

FIG. 2 is a cross-sectional view of the blower device 10 installed in the refrigerator of FIG. 1.

As illustrated in FIG. 2, the blower device 10 includes a housing 12 that has an inlet 12*a* and an outlet 12*b*, a centrifugal fan at the inlet 12*a* and that receives air through the inlet 12*a* and discharges air to the outlet 12*b*, and a motor 16 that drives (rotates) the centrifugal fan.

The centrifugal fan includes a plurality of vanes 14 and a shroud 15. Air flows from the inlet 12*a* of the housing to the outlet 12*b* of the housing. The shroud 15 connects the plurality of vanes 14 and guides the air from the inlet 12*a* to the inside of the centrifugal fan. The bottom 13 connects the plurality of vanes 14 at the side opposite the shroud 15.

The inlet 12*a* of the housing forms a bell mouth 11 that is rounded and forms a surface that curves (widens) toward the centrifugal fan, and that facilitates pulling or suction of air when the centrifugal fan rotates.

As such, the centrifugal fan has a structure in which the cool air from the evaporator 5 is introduced in the direction of the shaft of the motor 16 and is discharged in a centrifugal and/or orthogonal direction through the outlet 12*b*. The centrifugal fan reduces noise and power consumption in comparison to an axial-flow fan.

The shape (e.g., the bell mouth) and the width of the inlet 12*a* are appropriately designed for smooth, laminar air flow.

The shroud 15 can be designed to guide air through the inlet 12*a* and through the outlet 12*b*. The shape of the shroud 15 can depend on the shapes of the inlet 12*a* and the portion 11*a* of the bell mouth 11.

Air exiting at the outlet 12*b* can swirl, forming a vortex. As a result, collision loss occurs (e.g., reducing air flow) and/or excessive noise is generated.

SUMMARY

Embodiments according to the present disclosure pertain to a centrifugal fan that can be used in, for example, a refrigerator. A centrifugal fan in embodiments according to the present disclosure can prevent collision loss by preventing occurrence of a vortex by improving the fan's shroud structure and vanes, and also can reduce noise and power consumption.

In one or more embodiments, a centrifugal fan includes: a plurality of vanes arranged radially about a central shaft; a ring-shaped shroud coupled to the vanes and having (i) a curved portion that has a predetermined radius or curvature, and (ii) an angled portion that has a predetermined gradient or angle relative to the curved portion; and a bottom surface coupled to the vanes at the side opposite the shroud; where a ratio (r/R) of an inner diameter r, which is the shortest distance between the vanes and the shaft, and an outer diameter R, which is the longest distance between the vanes and the shaft, is approximately 0.69±0.01.

In one or more embodiments, the radius or the curvature of the curved portion of the shroud corresponds to a shape of an inlet of the shroud and an element extending from the shroud.

In one or more embodiments, the radius or the curvature of the curved portion of the shroud corresponds to an inlet width of the vanes and an outlet width of the shroud, and the angle of the angled portion relative to the curved portion corresponds to the inlet width and the outlet width of the shroud.

In one or more embodiments, a ratio of the outlet width of the shroud to a diameter of the vanes is approximately 0.16±0.01.

In one or more embodiments, a ratio of the inlet width of the vanes to the diameter of the vanes is approximately 0.24±0.01.

In one or more embodiments, the vanes have an inlet angle (e.g., that may be formed by tangents of the vanes [for example, at or from a center of the vanes] and a virtual inner circle C1 of the vanes) may be approximately 25°±1.

In one or more embodiments, the vanes have an outlet angle (e.g., that may be formed by tangents of the vanes [for example, from the center of the vanes] and a virtual outer circle C2 having of the vanes) may be approximately 37°±1.

In one or more embodiments, the vanes have a solidity ratio of approximately 1.0±0.1. Solidity may be defined as a ratio (L/P) of a pitch P, or the length of an arc that connects the outlet angles of adjacent vanes, to a chord L or the shortest distance between a front edge or periphery of a vane (e.g., the location of the vertex of the inlet angle) is and a rear edge or periphery of the vane (e.g., the location of the vertex of the outlet angle).

According to one or more embodiments of the present disclosure, the speed or rotation rate of the fan motor can be reduced (e.g., by approximately 100 to 150 rpm for a given air volume and/or flow rate, such as a flow rate of 35 CMH [cubic meters per hour]) relative to a conventional centrifugal fan.

According to one or more embodiments of the present disclosure, noise can be reduced (e.g., by approximately 3 to 4 dB) and/or power consumption can be reduced by approximately 22 to 30% for a given air volume and/or flow rate (e.g., a volume of 35 CMH), as compared with the conventional centrifugal fan.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 5(*d*) illustrates air flow for a shroud in one or more exemplary embodiments according to the present disclosure.

DETAILED DESCRIPTION

Figure 1:
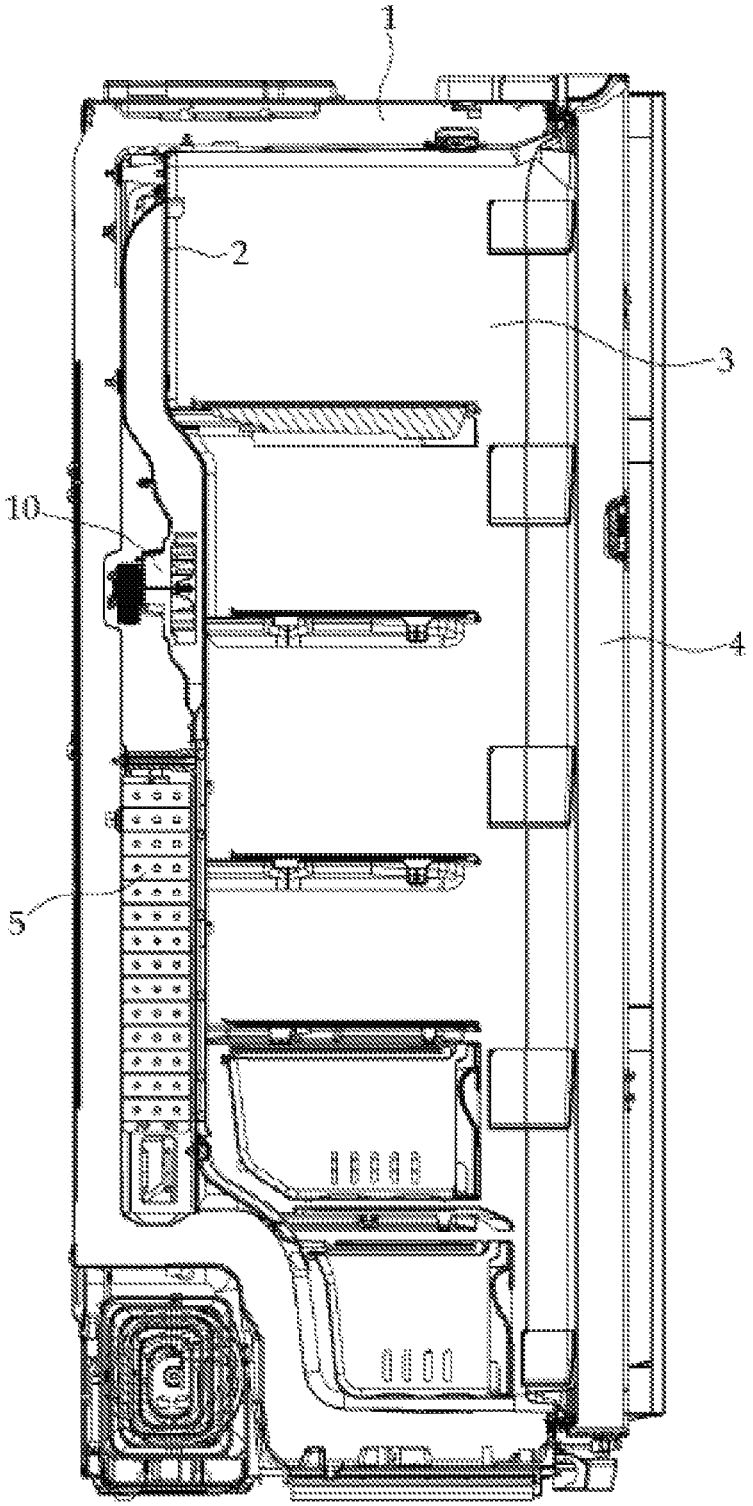
FIG. 1 (PRIOR ART)
FIG. 1 is a cross-sectional view of an example of a refrigerator.
Figure 2:
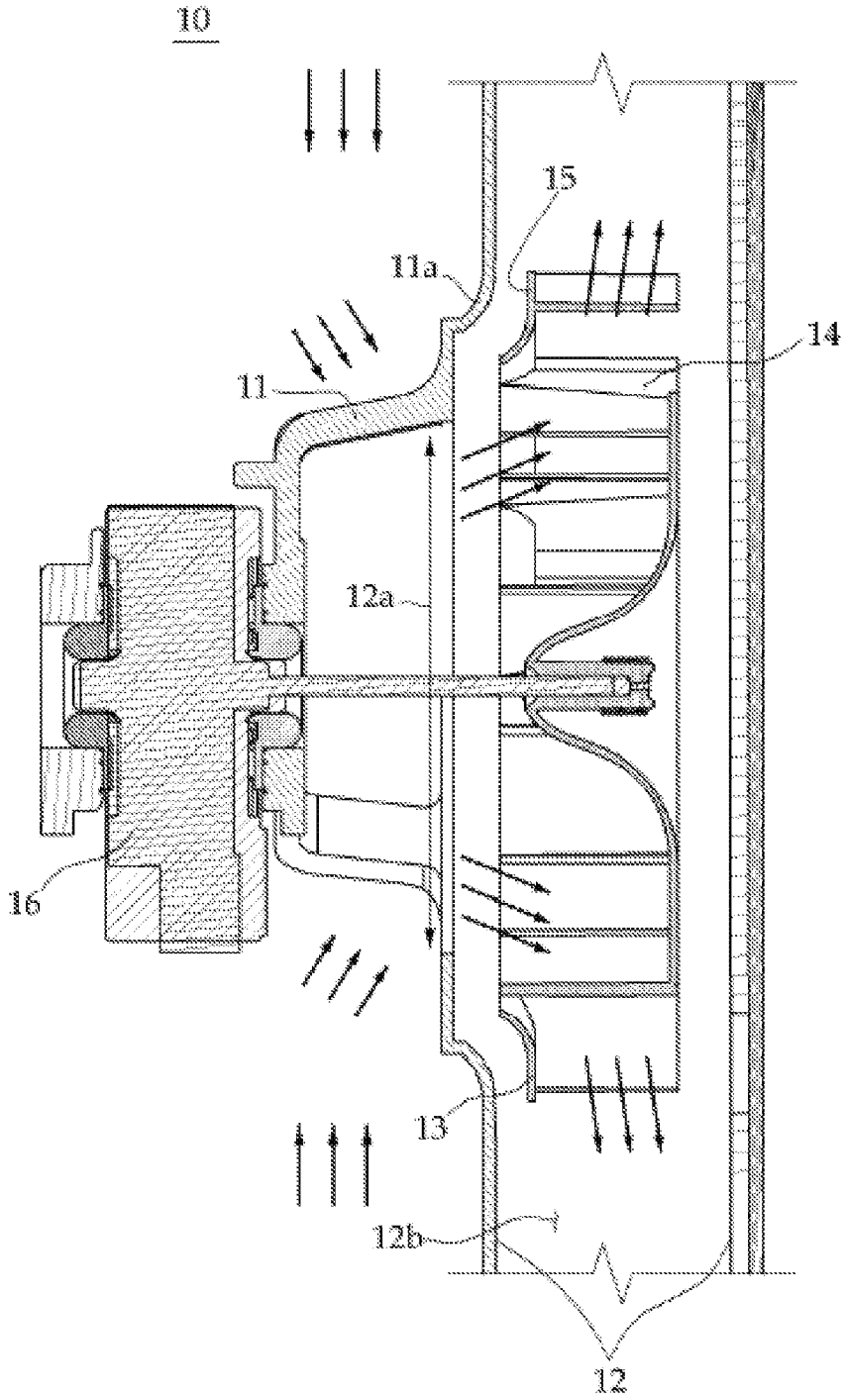
FIG. 2 (PRIOR ART)
FIG. 2 is a cross-sectional view of the blower device installed in the refrigerator of FIG. 1.

Hereinafter, exemplary embodiments according to the present disclosure will be described in detail with reference to the accompanying drawings.

In describing the exemplary embodiments, technical content that is well known in the technical field to which the present disclosure belongs and is not directly associated with the present disclosure may not be described. This is to more clearly describe and/or transfer the technical content by omitting unnecessary description(s).

Some components may be exaggerated in size or omitted or schematically illustrated in the accompanying drawings. The drawings are not necessarily drawn to scale. The same reference numerals refer to the same or corresponding components in each drawing.

Figure 3:
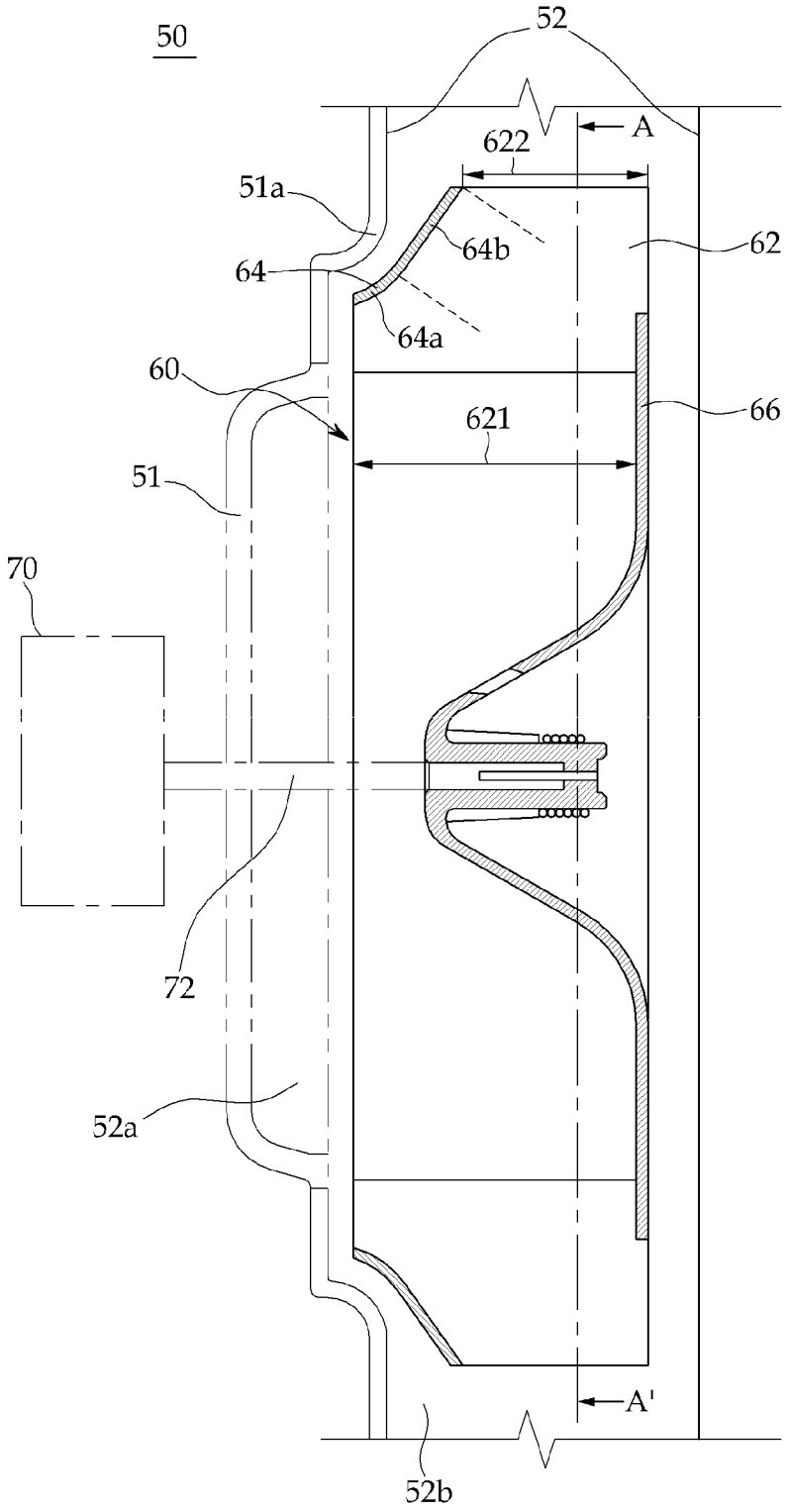
FIG. 3 is a diagram of a blower device in one or more exemplary embodiments according to the present disclosure.
Figure 4:
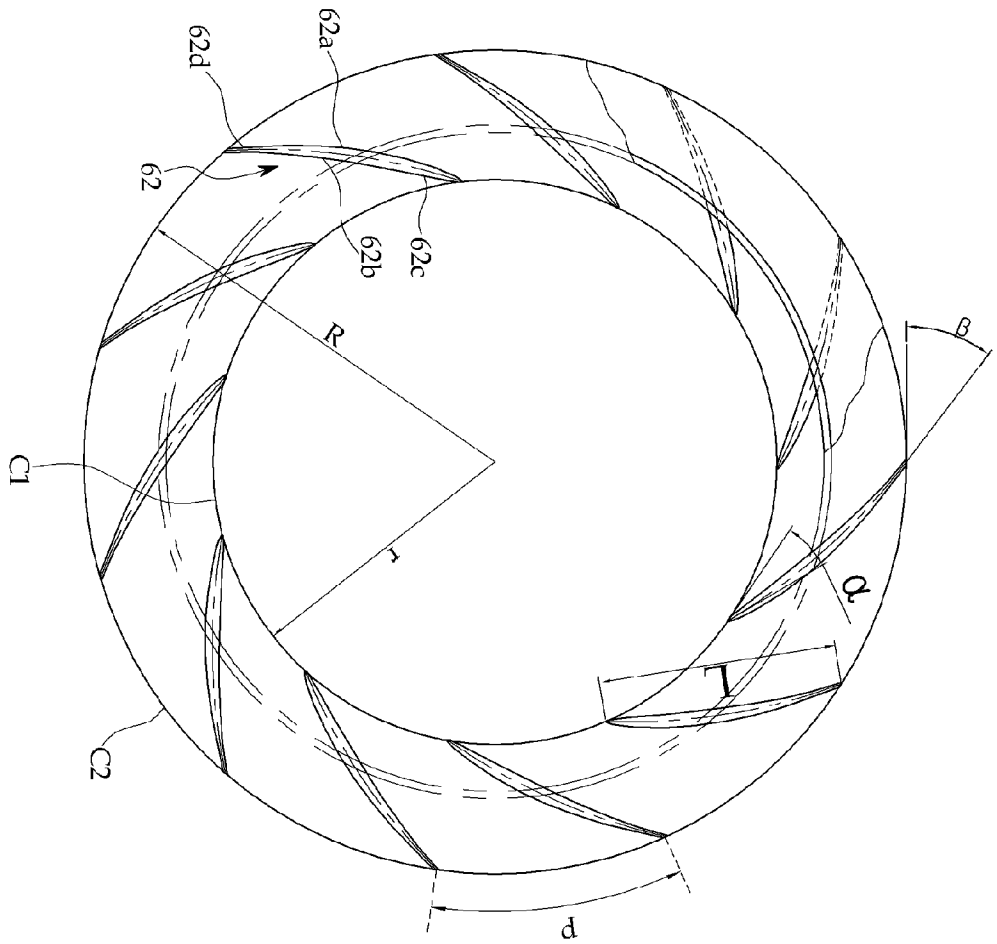
FIG. 4 is a cross-sectional view of the vanes of the exemplary centrifugal fan in one or more embodiments according to the present disclosure, along line A-A' of FIG. 3.

FIG. 3 is a diagram of a blower device 50 that includes a centrifugal fan 60 that can be used in, for example, a refrigerator or air conditioner in one or more exemplary embodiments according to the present disclosure. FIG. 4 is a cross-sectional view of the fan wheel and/or vanes of the centrifugal fan along line A-A' of FIG. 3.

Referring to FIG. 3, the blower device 50 includes a housing 52 that has an inlet 52*a* and an outlet 52*b*, a centrifugal fan 60 in the housing 52, and a motor 70 that drives (e.g., rotates) the centrifugal fan 60 via a shaft 72.

The housing 52 forms part of a flow path that circulates air into and through, for example, a refrigerator.

Cool air enters the centrifugal fan 60 through the inlet 52*a* of the housing 52. The inlet 52 forms a bell mouth 51. The bell mouth 51 is used to more efficiently introduce air into and through the housing 52. The bell mouth 51 is convex (the bell mouth widens from the surface facing the motor 70 towards the inlet 52*a* of the housing 52).

As illustrated in FIG. 3, the centrifugal fan 60 includes a plurality of vanes 62. Air is introduced through the inlet 52*a* of the housing 52 and flows to the outlet 52*b* of the housing 52. A ring-shaped shroud 64 connects the edges (e.g., upper exterior edges) of the plurality of vanes 62, and guides air from the inlet 52*a* to the inside of the centrifugal fan 60. A bottom surface 66 connects edges of the plurality of vanes 62 at the side opposite the shroud 64.

In other words, with reference to FIG. 4, the circle C1 corresponds to the inner edges of the vanes 62, which are on the bottom surface 66 and inside the shroud 64, and the circle C2 corresponds to the outer diameter of the ring-shaped shroud 64. Part of the bottom edge of each of the vanes 62 is connected to the bottom portion 66, and part of the top edge of each of the vanes is connected to the shroud 64. The vanes 62 may curve. In one embodiment, they may have a convex outer surface (e.g., facing away from the shaft 72 and/or towards the outlet 52*b*) and a substantially convex inner surface (e.g., facing towards the shaft 72); otherwise, the vanes 62 may be planar or substantially planar, and have a rectangular or substantially rectangular cross-section.

With reference to FIG. 3, the shroud 64 is separated from a neighboring element 51*a* that is connected to (extends from) the bell mouth 51 by a predetermined interval or distance.

The shroud 64 includes a curved portion 64*a* that has a predetermined radius or curvature, and an angled portion 64*b* that is angled by a predetermined amount (e.g., in degrees) relative to the curved portion 64*a*. Alternatively, the angled portion 64*b* may be angled by a predetermined amount (e.g., in degrees) relative to the planar portion of the bottom portion 66.

More specifically, the radius or curvature of the curved portion 64*a* is set according to the shapes of the inlet 52*a* and the element 51*a*. The radius or curvature of the curved portion 64*a* is set according to an inlet width or depth 621 and an outlet width or depth 622 of the shroud 64. The angle or gradient of the angled portion 64*b* may also be set according to the inlet width or depth 621 and the outlet width or depth 622 of the shroud 64.

In one or more embodiments, the inlet width or depth 621 is the actual width of the vanes 62 at the edge closest to the center of the centrifugal fan, without considering the thickness of the bottom surface 66 of the centrifugal fan 60 (e.g., the inlet width 621 is the distance between the top/outer edge of the shroud 64 and the top/inner side of the bottom portion 66). The ratio of the inlet width 621 to the diameter of the centrifugal fan 60 (e.g., the diameter of the fan wheel) is 0.24±0.01, or in the range of approximately 0.24±0.01. The outlet width 622 is the actual width of the vanes 62 at the edges farthest from the center of the centrifugal fan, without considering the thickness of the shroud 64 (e.g., the outlet width 622 is the distance from the bottom/inner edge of the shroud 64 and the bottom/outer side of the bottom portion 66). The ratio of the outlet width 622 to the diameter of the centrifugal fan 60 may be 0.16±0.01, or in the range of approximately 0.16±0.01.

As illustrated in FIG. 4, the vanes 62 have cross-sections that are shaped like an airplane wing or airfoil; in embodiments according to the present disclosure, the thickest cross-sectional portion of each vane is at or near the middle of the vane. Each of the vanes 62 includes a positive pressure surface 62*a* and a negative pressure surface 62*b*. The positive pressure surface may also be known as the pressure surface, and the negative pressure surface may be known as the suction surface. When the centrifugal fan 60 is turning, the vane 62 pushes air; thus, the pressure on the positive pressure surface 62*a* is higher than atmospheric pressure, and pressure is lower than atmospheric pressure on the negative pressure surface 62*b*. Each vane 62 includes: a front peripheral portion 62*c* on the pressure surface 62*a* and the negative pressure surface 62*b* that contacts cool air introduced through the inlet 52*a*; and a rear peripheral portion 62*d* on an outer circumference of the centrifugal fan 60 on the pressure surface 62*a* and the negative pressure surface 62*b*, and which discharges cool air to the outlet 52*b*.

The vanes 62 form a virtual inner circle C1 with a radius r from the motor shaft 72 to the front peripheral portion 62*c*, and also form a virtual outer circle C2 with a radius R from the motor shaft 72 to the rear peripheral portion 62*d*. The inner radius r is the shortest distance between an inner edge of a vane of the plurality of vanes and the shaft, and an outer radius R is the longest distance between an outer edge of the vane and the shaft. The diameter of the circle C1 may be referred to herein as the minimum fan wheel diameter and thus the radius r may be referred to as the minimum fan wheel radius. The diameter of the circle C2 may be referred to herein as the maximum fan wheel diameter and thus the radius R may be referred to as the maximum fan wheel radius.

In one or more embodiments according to the present disclosure, the ratio r/R (the radius r of the inner circle C1 to the radius R of the outer circle C2) is 0.69±0.01, or in a range of approximately 0.69±0.01.

An inlet angle $\alpha$ is defined herein as the angle between a tangent of the inner circle C1 and the front peripheral portion 62*c* of a vane 62. The angle $\alpha$ may also be known as the angle of attack. In one or more embodiments according to the present disclosure, the inlet angle $\alpha$ may be 25°±1, or in a range of approximately 25°±1. An outlet angle $\beta$ is defined herein as the angle between a tangent of the outer circle C2 and the rear peripheral portion 62*d* of a vane 62. The angle $\beta$ may also be known as the blade angle. In one or more embodiments according to the present disclosure, the outlet angle $\beta$ may be 37°±1, or in a range of approximately 37°±1.

The outer tips and/or edges of the vanes 62 are separated from each other by a pitch P, which may be the length of an arc that connects the outer tips/edges of adjacent vanes (e.g., the length of an arc that connects an outlet angle $\beta$ in the outer circle C2 between the rear periphery portions 62*d* of any one vane and the nearest vane adjacent thereto and an outlet angle $\beta$ of the nearest/adjacent vane 62). If the vanes 62 are uniformly spaced, then the pitch is the circumference of the outer circle C2 divided by the number of vanes 62. At least one of the vanes 62 has a chord (e.g., a one-dimensional line from the innermost edge to the outermost edge, or between the vertices of the inner and outer angles) having a length L. A chord may also be a straight line that connects the front peripheral portion 62*c* and the rear peripheral portion 62*d*. In other words, a chord is generally a straight line connecting the leading and trailing edges of a vane 62. Typically, all of the vanes 62 have the same chord. In one or more embodiments according to the present disclosure, the ratio L/P, or blade solidity ratio, of the chord L and the pitch P is in the range of 1.0±0.1.

Figure 5:
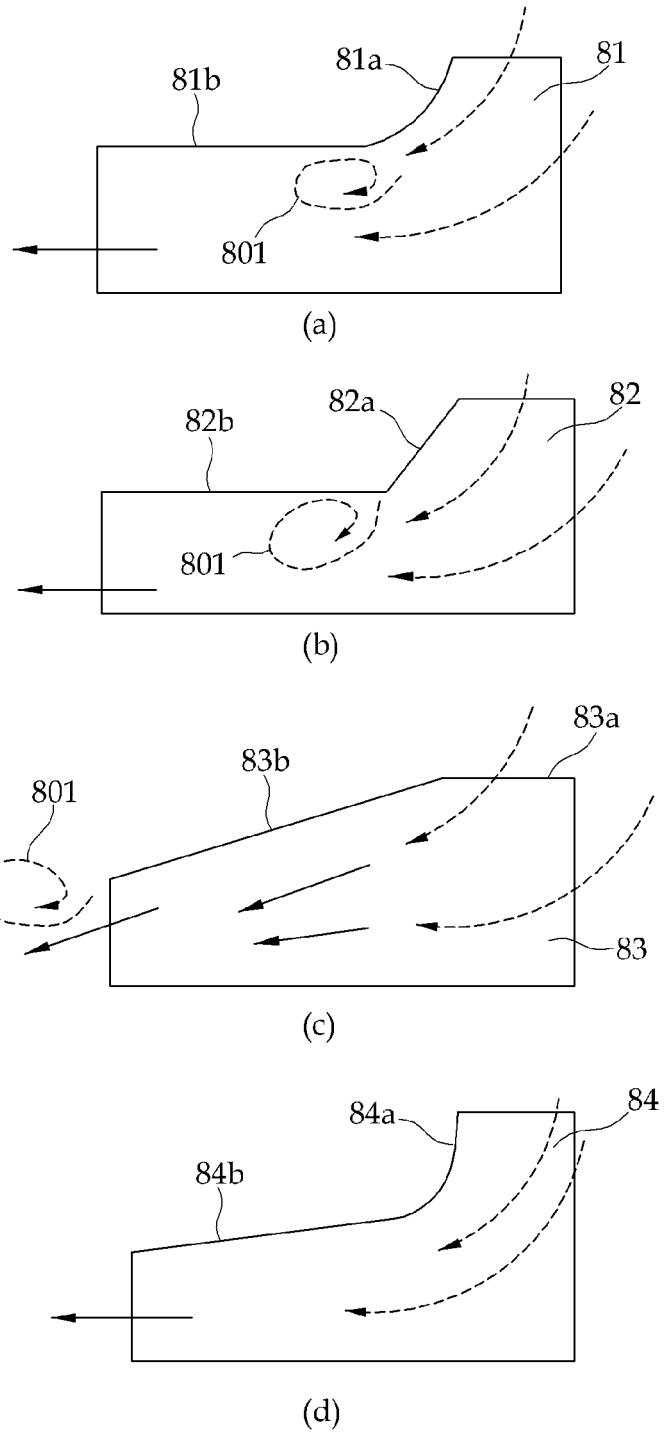
FIGS. 5(*a*), 5(*b*), and 5(*c*) illustrate vortex characteristics for various shroud shapes.

FIGS. 5(*a*), 5(*b*), and 5(*c*) illustrate a vortex caused by different shroud shapes that may be used in conventional centrifugal fans.

As illustrated in FIG. 5(*a*), when a shape 81 of the shroud has a round or curved portion 81*a* and a horizontal portion 81*b*, a vortex occurs at an interface between the round portion 81*a* and the horizontal portion 81*b*, generally toward the outlet.

As illustrated in FIG. 5(*b*), when a shape 82 of the shroud has a tapered portion 82*a* and a horizontal portion 82*b*, a vortex larger than that of FIG. 5A occurs in the horizontal portion 81*b*, past the interface between the round portion 81*a* and the horizontal portion 81*b*, toward the outlet.

As illustrated in FIG. 5(*c*), when a shape 83 of the shroud from a horizontal inlet 83*a* is only tilted (e.g., tapered surface 83*b*), collision loss resistance with a duct at or near the outlet is generated by a shaft-direction velocity component (e.g., of the air flow from the fan).

FIG. 5(*d*) illustrates an exemplary air flow using embodiments of a shroud according to the present disclosure (e.g., the shroud 64 of FIG. 3). As illustrated in FIG. 5(*d*), in one or more embodiments according to the present disclosure, the shape 84 of the shroud 64 includes a curved portion 84*a* (64*a*) and an angled portion 84*b* (64*b*). Consequently, a vortex does not occur within or below the shroud or at the outlet, and collision losses are reduced.

Figure 6:
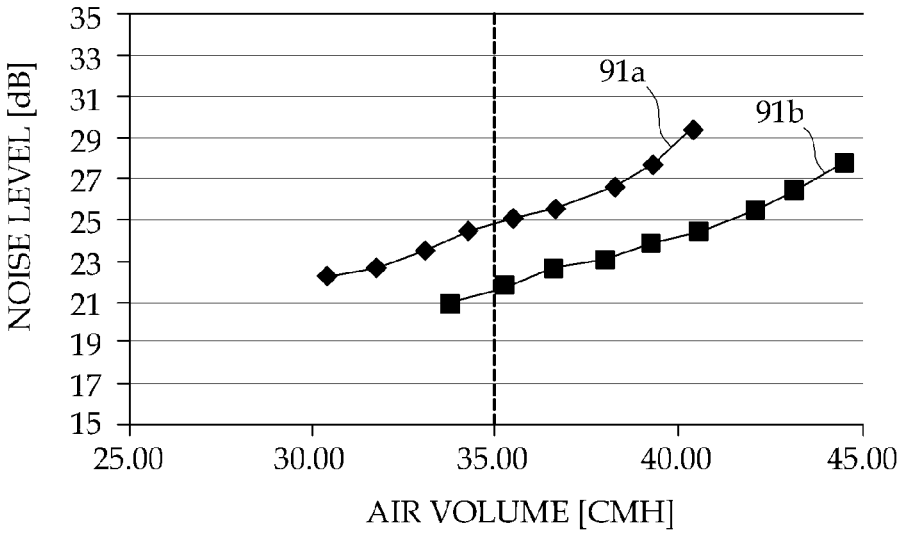
FIG. 6 is a diagram illustrating comparative experimental results for noise level versus air volume flow rate.
Figure 7:
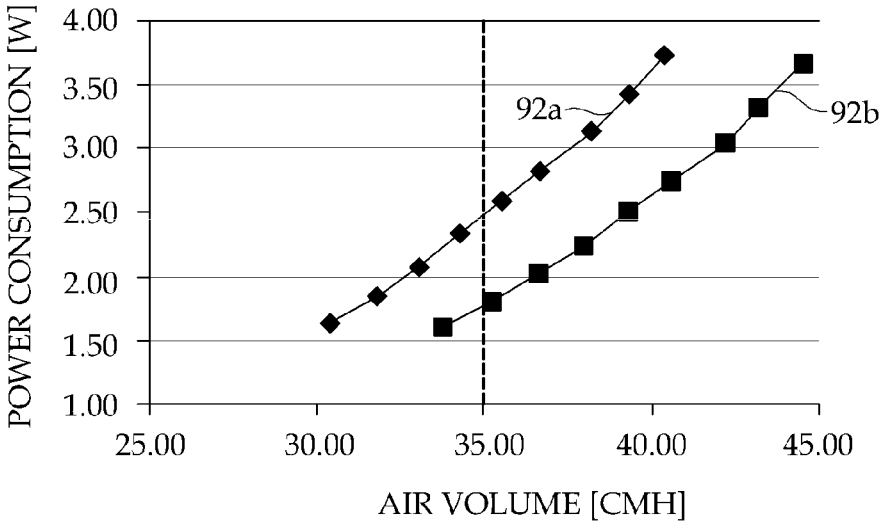
FIG. 7 is a diagram illustrating comparative experimental results for power consumption versus air volume flow rate.

FIG. 6 is a diagram illustrating comparative results of experiments measuring noise level versus air volume flow rate in a centrifugal fan according to exemplary embodiment (s) of the present disclosure (e.g., having a shroud with a shape similar to or the same as FIG. 5(*d*)) and in a conventional centrifugal fan (e.g., having a shroud with a shape similar to or the same as FIG. 5(*a*)). FIG. 7 is a diagram illustrating results of experiments measuring power consumption versus air volume/flow rate in a centrifugal fan according to exemplary embodiment(s) of the present disclosure and in a conventional centrifugal fan.

A noise level result 91*b* for the centrifugal fan 60 according to exemplary embodiment(s) of the present disclosure and a noise level result 91*a* for the conventional centrifugal fan are illustrated in FIG. 6. The centrifugal fan 60 generates less noise than the conventional centrifugal fan. For example, at an air volume flow rate of 35 CMH, the noise level of the centrifugal fan 60 is in the range of 21 to 22 dB (A), and the noise level of the conventional centrifugal fan is in the range of 24 to 25 dB (A). Thus, the noise level of the centrifugal fan 60 is 3 to 4 dB (A) lower than that of the conventional centrifugal fan. Alternatively, at the same noise level, the fan according to embodiment(s) of the present disclosure can move or circulate a volume of air over time that is about 15-20% or greater than the conventional centrifugal fan.

Meanwhile, a power consumption result 92*b* for the centrifugal fan 60 according to exemplary embodiment(s) of the present disclosure and a power consumption result 92*a* for the conventional centrifugal fan are illustrated in FIG. 7. The power consumption of the present exemplary centrifugal fan 60 is lower than that of the conventional centrifugal fan. For example, the power consumption of the present exemplary centrifugal fan 60 is approximately 1.75 W for an air volume/flow rate of 35 CMH, and the power consumption of the conventional centrifugal fan is approximately 2.5 W at that air volume/flow rate. Thus, the power consumption of the centrifugal fan 60 is approximately 22 to 30% lower than that of the conventional centrifugal fan, and the improvement may increase at higher air flow rates.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure will not limit the present disclosure. The scope of the present disclosure will be interpreted by the claims below, and it will be construed that all techniques within the scope equivalent thereto belong to the scope of the present disclosure.

What is claimed is:

1. A centrifugal fan operable for use in a refrigerator, the centrifugal fan comprising:

a plurality of vanes arranged radially about a central shaft;

a ring-shaped shroud coupled to the vanes and comprising (i) a curved portion having a radius or curvature and (ii) an angled portion at an angle relative to the curved portion; and a bottom surface coupled to the vanes opposite the shroud, wherein the curved portion of shroud is formed closer to the inlet direction than the angled portion of shroud, wherein the shroud guides air from the curved portion to the angled portion, and wherein a ratio (r/R) of an inner radius r, which is the shortest distance between an inner edge of a vane of the plurality of vanes and the shaft, and an outer radius R, which is the longest distance between an outer edge of the vane and the shaft, is in a range of 0.69±0.01.

2. The centrifugal fan of claim 1, wherein the radius or the curvature of the curved portion corresponds to a shape of an inlet of the shroud and an element extending from the shroud.

3. The centrifugal fan of claim 1, wherein the radius or the curvature of the curved portion corresponds to an inlet width of the vane and an outlet width of the shroud, and the angle of the angled portion relative to the curved portion corresponds to the inlet width and the outlet width.

4. The centrifugal fan of claim 1, wherein a ratio of an outlet width of the shroud to a diameter of the centrifugal fan is in a range of 0.16±0.01.

5. The centrifugal fan of claim 1, wherein a ratio of an inlet width of the vane to a diameter of the centrifugal fan is in a range of 0.24±0.01.

6. The centrifugal fan of claim 1, wherein the vane has an inlet angle in a range of 25°±1.

7. The centrifugal fan of claim 1, wherein the vane has an outlet angle in a range of 37°±1.

8. The centrifugal fan of claim 1, wherein is the vane has a solidity ratio in a range of 1.0±0.1.

9. A refrigerator, comprising:

an evaporator;

a compartment; and a centrifugal fan configured to circulate air from the evaporator to the compartment, the centrifugal fan comprising a fan wheel comprising:

a plurality of vanes;

a ring-shaped shroud coupled to the vanes and comprising (i) a curved portion having a radius or curvature and (ii) an angled portion that is at an angle relative to the curved portion; and a surface coupled to the vanes opposite the shroud, wherein the curved portion of shroud is formed closer to the inlet direction than the angled portion of shroud, wherein the shroud guides air from the curved portion to the angled portion, and wherein a ratio (r/R) of a minimum radius of the fan wheel and a maximum radius of the fan wheel is in a range of 0.69±0.01.

10. The refrigerator of claim 9, wherein the radius or the curvature of the curved portion corresponds to a shape of an inlet of the shroud and an element extending from the shroud.

11. The refrigerator of claim 9, wherein the radius or the curvature of the curved portion corresponds to an inlet width of the vane and an outlet width of the shroud, and the angle of the angled portion relative to the curved portion corresponds to the inlet width and the outlet width.

12. The refrigerator of claim 9, wherein a ratio of an outlet width of the shroud to a maximum diameter of the fan wheel is in a range of 0.16±0.01.

13. The refrigerator of claim 9, wherein a ratio of an inlet width of the vane to a maximum diameter of the fan wheel is in a range of 0.24±0.01.

14. The refrigerator of claim 9, wherein the vane has an angle of attack in a range of 25°±1.

15. The refrigerator of claim 9, wherein the vane has a blade angle in a range of 37°±1.

16. The refrigerator of claim 9, wherein the vane has a solidity ratio in a range of 1.0±0.1.

* * * * *